US007999643B1

(12) United States Patent
Dening et al.

(10) Patent No.: US 7,999,643 B1
(45) Date of Patent: Aug. 16, 2011

(54) PROVIDING A COMMON ENVIRONMENT FOR MULTIPLE MEMS DEVICES

(75) Inventors: David C. Dening, Stokesdale, NC (US); Tony Ivanov, Summerfield, NC (US); Julio Costa, Summerfield, NC (US)

(73) Assignee: RF Micro Devices, Inc., Greensboro, NC (US)

( * ) Notice: Subject to any disclaimer, the term of this patent is extended or adjusted under 35 U.S.C. 154(b) by 307 days.

(21) Appl. No.: 12/129,928

(22) Filed: May 30, 2008

Related U.S. Application Data

(60) Provisional application No. 60/941,048, filed on May 31, 2007.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,777,630 | B1 * | 8/2004 | Dove et al. | 200/182 |
| 7,071,432 | B2 * | 7/2006 | Lindsey | 200/182 |
| 7,106,066 | B2 | 12/2006 | Ivanciw et al. | |
| 7,663,196 | B2 * | 2/2010 | Liu et al. | 257/416 |
| 2004/0257086 | A1 | 12/2004 | Montrose et al. | |
| 2005/0096878 | A1 | 5/2005 | Ivanciw et al. | |
| 2005/0167047 | A1 * | 8/2005 | Huff et al. | 156/345.1 |
| 2006/0033594 | A1 * | 2/2006 | Lutz et al. | 333/186 |
| 2007/0090902 | A1 * | 4/2007 | Deligianni et al. | 335/78 |
| 2008/0169707 | A1 | 7/2008 | Wright et al. | |

OTHER PUBLICATIONS

Czaplewski, David A. et al., "A Soft-Landing Waveform for Actuation of a Single-Pole Single-Throw Ohmic RF MEMS Switch," Journal of Microelectromechanical Systems, Dec. 2006, pp. 1586-1594, vol. 15, No. 6, IEEE.

McCarthy, Brian et al., "A Dynamic Model, Including Contact Bounce, of an Electrostatically Actuated Microswitch," Journal of Microelectromechanical Systems, Jun. 2002, pp. 276-283, vol. 11, No. 3, IEEE.

Nonfinal Office Action mailed Dec. 22, 2010 regarding U.S. Appl. No. 12/117,976.

Nonfinal Office Action mailed Dec. 23, 2010 regarding U.S. Appl. No. 12/118,031.

* cited by examiner

*Primary Examiner* — Anh T Mai
*Assistant Examiner* — Bernard Rojas
(74) *Attorney, Agent, or Firm* — Withrow & Terranova, P.L.L.C.

(57) ABSTRACT

The present invention relates to providing a uniform operating environment for each of multiple devices by providing a common environment to the devices. The common environment is provided by multiple cavities, which are interconnected by at least one environmental pathway, which may be provided by at least one tunnel. The common environment may help provide uniform operating pressure, which may be a partial or near vacuum, a surrounding gas of uniform contents, such as an inert gas or mixture of inert gases, or both. The devices may include micro-electro-mechanical system (MEMS) devices, such as MEMS switches.

29 Claims, 15 Drawing Sheets

PROVIDING A COMMON ENVIRONMENT FOR MULTIPLE MEMS DEVICES

This application claims the benefit of U.S. provisional patent application Ser. No. 60/941,048 filed May 31, 2007, the disclosure of which is incorporated herein by reference in its entirety.

CROSS-REFERENCE TO RELATED APPLICATION

This application is related to U.S. patent application Ser. No. 12/117,976 entitled CONTROLLED CLOSING OF MEMS SWITCHES and to U.S. patent application Ser. No. 12/118,031 entitled CONTROLLED OPENING OF MEMS SWITCHES, both of which were filed May 9, 2008, and both of which are incorporated herein by reference in their entireties, and form part of the specification and teachings herein.

FIELD OF THE INVENTION

The present invention relates to micro-electro-mechanical system (MEMS) devices, such as MEMS switches, and in particular to controlling actuation of MEMS switches to improve performance.

BACKGROUND OF THE INVENTION

As electronics evolve, there is an increased need for miniature switches that are provided on semiconductor substrates along with other semiconductor components to form various types of circuits. These miniature switches often act as relays, and are generally referred to as micro-electro-mechanical system (MEMS) switches. In many applications, MEMS switches may replace field effect transistors (FETs), and are configured as switches to reduce insertion losses due to added resistance as well as parasitic capacitance and inductance inherent in providing FET switches in a signal path. MEMS switches are currently being considered in many radio frequency (RF) applications, such as antenna switches, load switches, transmit/receive switches, tuning switches, and the like. Some applications utilize multiple MEMS devices, such as MEMS switches, which may have specific electrical requirements, mechanical requirements, or both. Additionally, consistency of electrical characteristics, mechanical characteristics, or both between MEMS devices may be necessary. Providing a uniform operating environment may help provide consistent characteristics. Thus, there is a need to provide a uniform operating environment to multiple MEMS devices.

Turning to FIGS. 1A and 1B, a MEMS device 10 having a MEMS switch 12 is illustrated according to one embodiment of the present invention. The MEMS switch 12 is formed on an appropriate substrate 14. The MEMS switch 12 includes a movable member, such as a cantilever 16, which is formed from a conductive material, such as gold. The cantilever 16 has a first end and a second end. The first end is coupled to the substrate 14 by an anchor 18. The first end of the cantilever 16 is also electrically coupled to a first conductive pad 20 at or near the point where the cantilever 16 is anchored to the semiconductor substrate 14. Notably, the first conductive pad 20 may play a role in anchoring the first end of the cantilever 16 to the semiconductor substrate 14 as depicted. In one embodiment of the present invention, a semiconductor die provides the substrate 14.

The second end of the cantilever 16 forms or is provided with a cantilever contact 22, which is suspended over a contact portion 24 of a second conductive pad 26. Thus, when the MEMS switch 12 is actuated, the cantilever 16 moves the cantilever contact 22 into electrical contact with the contact portion 24 of the second conductive pad 26 to electrically connect the first conductive pad 20 to the second conductive pad 26. The MEMS switch 12 may be encapsulated by one or more encapsulating layers 30, which form a substantially hermetically sealed cavity about the cantilever 16. The cavity is generally filled with an inert gas and sealed in a near vacuum state. Once the encapsulation layers 30 are in place, an overmold material 32 may be provided over the encapsulation layers 30 as part of a high volume packaging process.

To actuate the MEMS switch 12, and in particular to cause the cantilever 16 to move the cantilever contact 22 into contact with the contact portion 24 of the second conductive pad 26, an actuator plate 28 is disposed over a portion of the substrate 14 and under the middle portion of the cantilever 16. To actuate the MEMS switch 12, an electrostatic voltage is applied to the actuator plate 28. The presence of the electrostatic voltage over time creates a field that moves the metallic cantilever 16 toward the actuator plate 28, thus moving the cantilever 16 from the position illustrated in FIG. 1A to the position illustrated in FIG. 1B.

Unfortunately, actuation of a MEMS switch 12, especially one maintained at near vacuum conditions, results in the cantilever 16 moving downward with a momentum sufficient to cause the cantilever contact 22 to bounce one or more times off of the contact portion 24 of the second conductive pad 26 after initial contact. Such bouncing degrades circuit performance and effectively increases the closing time. The article entitled "A Dynamic Model, Including Contact Bounce, of an Electrostatically Actuated Microswitch," by Brian McCarthy et al., provides a detailed analysis of this bouncing phenomenon and is incorporated herein by reference. The dynamic closing forces may also be sufficient to damage both the contact portion 24 of the second conductive pad 26 as well as the cantilever contact 22, thus causing excessive wear, which results in a shortened operating life for the MEMS switch 12.

As a result, efforts have been made to control the force at which the cantilever 16 is pulled down to reduce bouncing. In particular, an actuation signal having a special waveform is initially applied to the actuator plate 28. The actuation signal moves the cantilever 16 downward, such that the contact pad 22 at the end of the cantilever 16 initially moves rapidly toward the contact portion 24 of the second conductive pad 26. The actuation signal is configured such that the effective electrostatic voltage is reduced or removed prior to the cantilever contact 22 coming into contact with the contact portion 24 of the second conductive pad 26. The downward momentum will continue to move the cantilever 16 downward, albeit at a decreasing rate, wherein the contact pad 22 lands softly and slowly on the contact portion 24 of the second conductive pad 26. Once the MEMS switch 12 is closed, a hold signal is applied to actuator plate 28 to hold the cantilever 16 in a closed position such that the contact pad 22 is held in contact with the contact portion 24 of the second conductive pad 26. The article "A Soft-Landing Waveform for Actuation of a Single-Pole Single-Throw Ohmic RF MEMS Switch," by David A. Czaplewski et al., provides a technique for providing a pre-determined actuation signal to control the closing of a MEMS switch 12 and is incorporated herein by reference.

Providing an actuation signal to effect soft closings of the MEMS switches 12 theoretically reduces bouncing and increases the operating life of the device. In practice however, process variation in the switch manufacture will reduce or eliminate the efficiency of a single waveform to effect soft closing as described.

For example, if the gap between the cantilever 16 and the actuator plate 28 increases due to manufacturing variation, a nominal actuation signal may not be strong enough to move the cantilever 16 enough to provide a soft closing. As such, when the hold signal is subsequently applied, bouncing may occur if the cantilever contact 22 is not proximate the contact portion 24 of the second conductive pad 26. Conversely, if the gap between the cantilever 16 and the actuator plate 28 decreases due to manufacturing variation the nominal actuation signal may be too much, thus causing a hard closing, which may induce bouncing or damage. Further, humidity, temperature, aging, and wear may play a role in changing the mechanical characteristics, and thus operation, of MEMS switches 12. Accordingly, there is a need for a technique to reduce or eliminate bouncing in MEMS switches 12 over various process variations and operating conditions.

MEMS switches 12 also have issues associated with being released from a closed position, or opening. The cantilever 16 is effectively a metallic beam, which is deflected when the MEMS switch 12 is closed and suspended in a natural state when the MEMS switch 12 is open. Releasing the MEMS switch 16 entails turning off the hold signal, and thus releasing the deflected cantilever 16 from the closed position. Once released, the cantilever 16 springs upward and begins mechanically oscillating up and down. Such mechanical oscillation is referred to as ringing, and in a cavity in a near vacuum state this ringing may continue for an extended period of time. Further, the magnitude and time of ringing may vary over various operating conditions and process variations.

If the cantilever 16 is still ringing when the next actuation signal is applied, the nominal actuation signal may not provide a soft closing given the cantilever's position, upward momentum, downward momentum, or a combination thereof. And, during this ringing, the electrical isolation provided by the switch may be reduced, effectively prolonging the true opening time of the switch. Accordingly, there is a further need for a technique to reduce or eliminate ringing of MEMS switches 12 over various operating conditions and process variations.

SUMMARY OF THE INVENTION

The present invention relates to providing a uniform operating environment for each of multiple devices by providing a common environment to the devices. The common environment is provided by multiple cavities, which are interconnected by at least one environmental pathway, which may be provided by at least one tunnel. The common environment may help provide uniform operating pressure, which may be a partial or near vacuum, a surrounding gas of uniform contents, such as an inert gas or mixture of inert gases, or both. The devices may include micro-electro-mechanical system (MEMS) devices, such as MEMS switches.

In one embodiment of the present invention, multiple MEMS switches that are similar in nature are provided a common environment along with switch control circuitry. Of the MEMS switches, one MEMS switch is reserved as a test MEMS switch while the one or more remaining MEMS switches are active, and are thus used during normal operation of the electronic circuitry that incorporates the MEMS switches. The switch control circuitry will use the test MEMS switch to adaptively determine an actuation signal that is sufficient to effect a near closing or soft closing of the test MEMS switch. The switch control circuitry may also determine a closing time that defines a time when the test MEMS switch closes relative to application of the actuation signal. The actuation signal and closing time may be updated regularly, if not continuously.

To close any one the active MEMS switches, the switch control circuitry will apply the adaptive actuation signal, which was derived from analyzing the closing of the test MEMS switch, to the active MEMS switch. Application of the actuation signal should result in a soft closing, or at least a near closing, of the active MEMS switch. To maintain the active MEMS switch closed, a hold signal is applied at the closing time. Given the near closing or soft closing in response to the actuation signal and the timely application of the subsequent hold signal, bouncing of the movable member, such as the cantilever, in the active MEMS switch is minimized, if not completely eliminated.

In another embodiment of the present invention, the switch control circuitry may provide a release signal configured to reduce or minimize ringing, which is normally associated with opening a MEMS switch from a closed position. When the hold signal is released, a release signal is applied to the actuator plate to effectively counter or slow the rate at which the movable member actually moves back toward the normal resting position. The normal resting position generally corresponds to a non-actuated state. By slowing down the rate at which the cantilever returns to a normal resting position after closing, mechanical oscillations are controlled, and thus, ringing of the active MEMS switches is minimized or eliminated.

In an additional embodiment of the present invention, one or more of the MEMS switches is a hybrid MEMS switch, which may have a pair of test contacts and a pair of normal contacts. The normal contacts are used during normal operation of the electronic circuitry that incorporates the MEMS switches. The switch control circuitry will use the test contacts to adaptively determine an actuation signal that is sufficient to effect a near closing or soft closing of the hybrid MEMS switch.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 4:
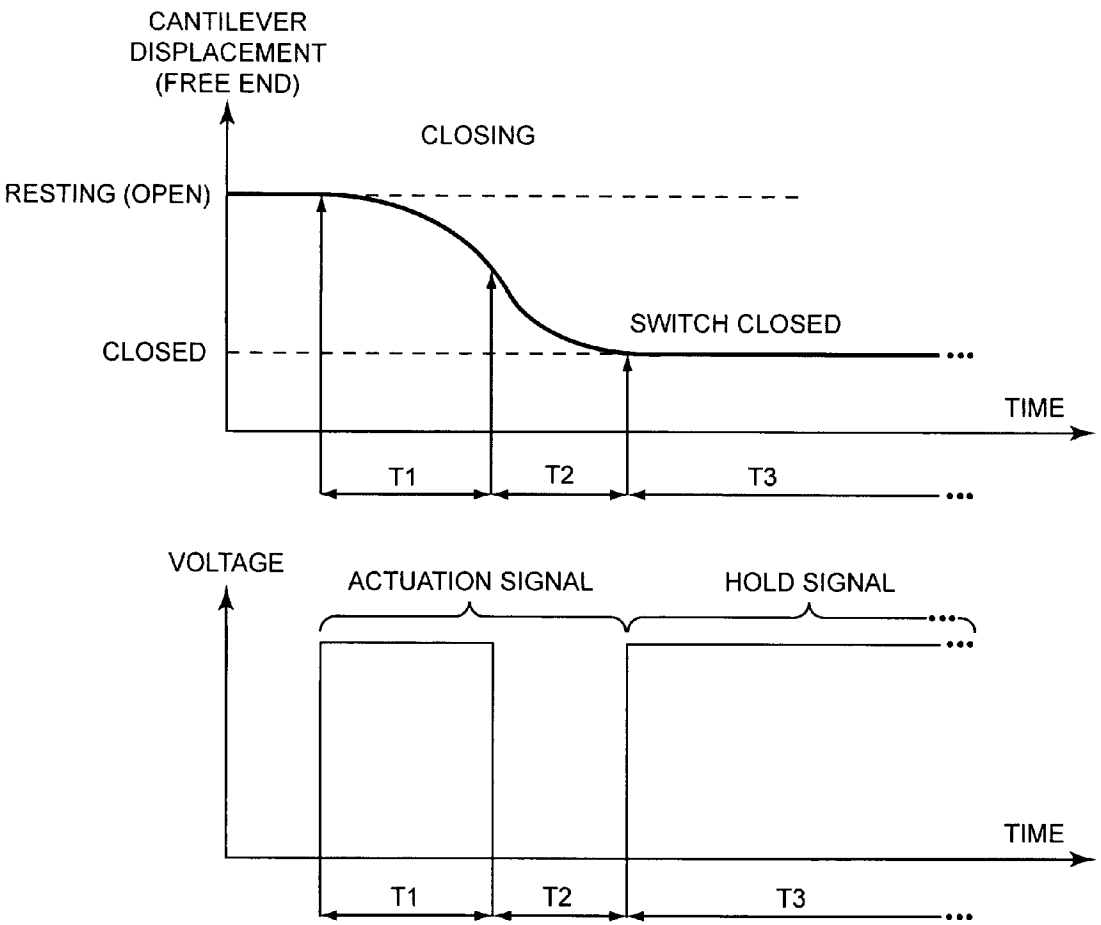

FIG. 4 provides timing diagrams illustrating the position of the free end of a MEMS switch's cantilever in response to an adaptive actuation signal and a subsequent hold signal according to one embodiment of the present invention.

Figure 5:
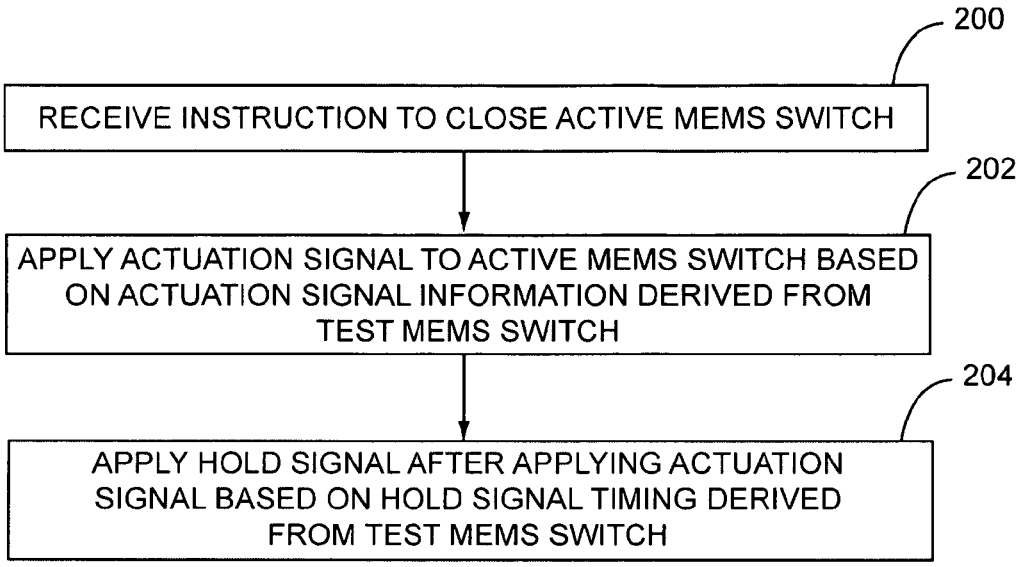

FIG. 5 is a flow diagram illustrating a process for closing a MEMS switch using an adaptive actuation signal according to one embodiment of the present invention.

Figure 6:
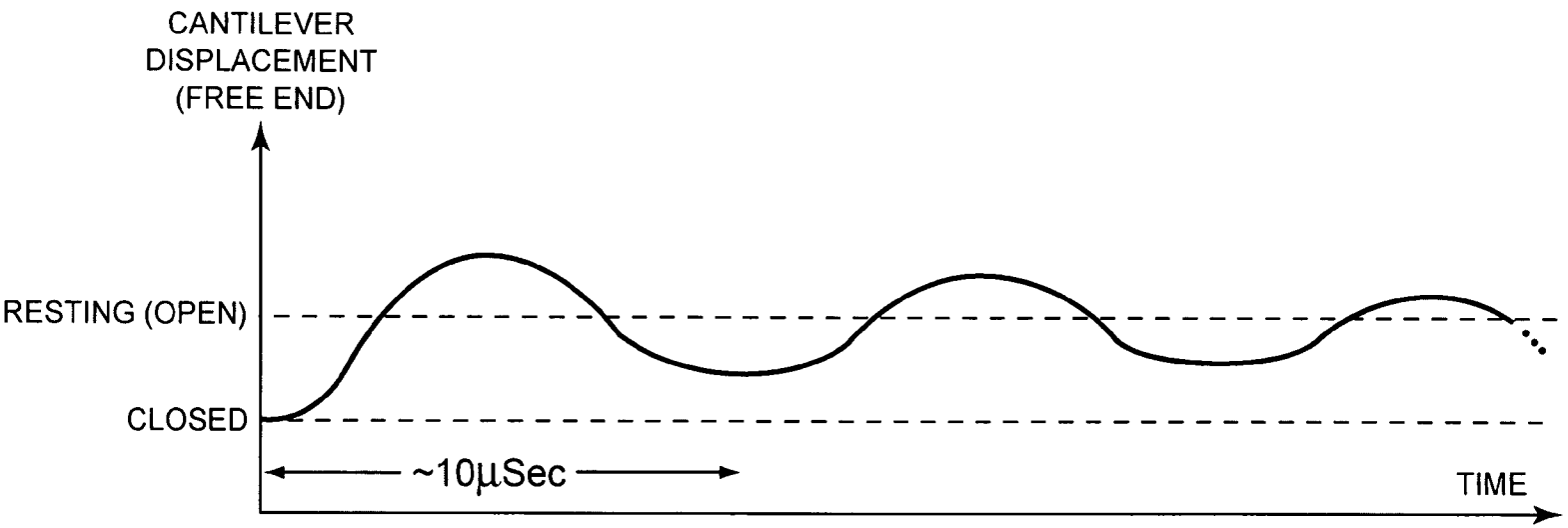

FIG. 6 illustrates mechanical oscillation, or ringing, of the free end of a MEMS switch's cantilever after releasing a hold signal according to one embodiment of the present invention.

Figure 7:
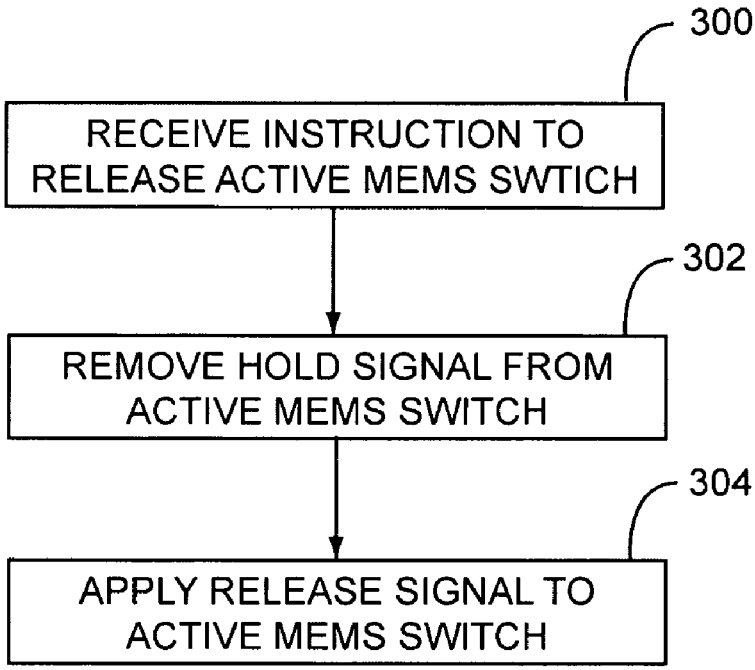

FIG. 7 is a flow diagram illustrating a process for opening a MEMS switch using a release signal according to one embodiment of the present invention.

Figure 8:
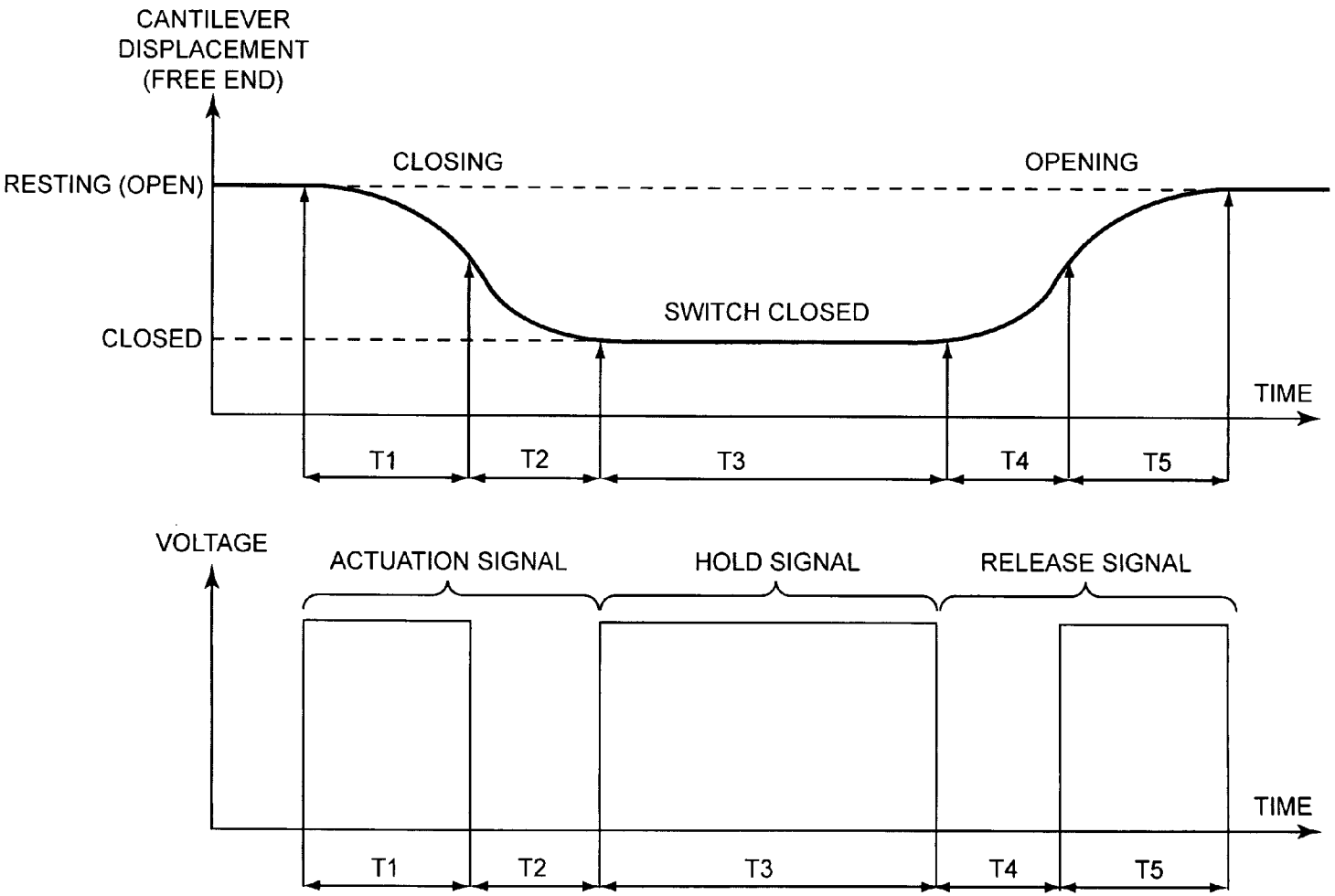

FIG. 8 provides timing diagrams illustrating the position of the free end of a MEMS switch's cantilever in response to successive application of an adaptive actuation signal, a hold signal, and a release signal according to a first embodiment of the present invention.

Figure 9:
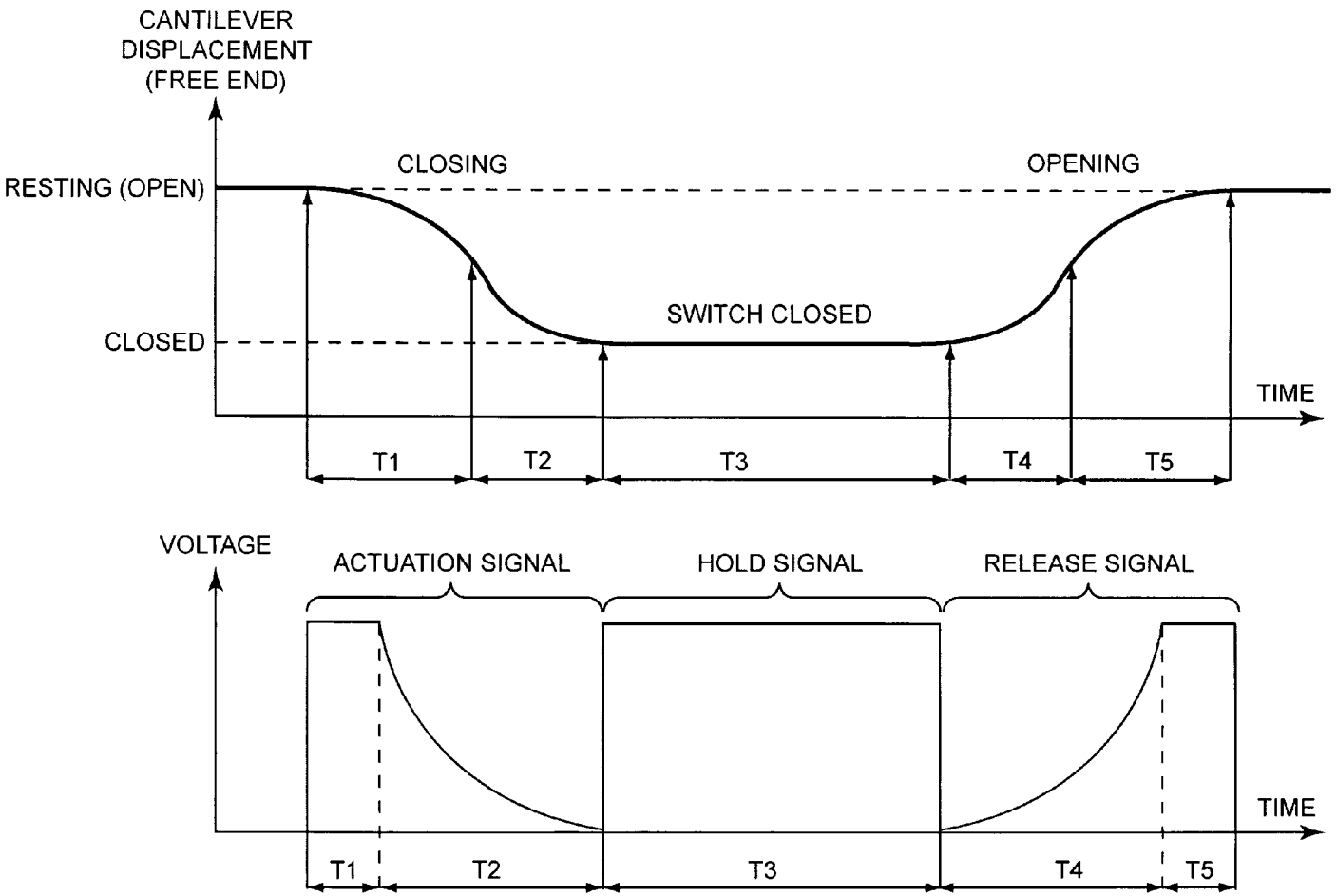

FIG. 9 provides timing diagrams illustrating the position of the free end of a MEMS switch's cantilever in response to successive application of an adaptive actuation signal, a hold signal, and a release signal according to a second embodiment of the present invention.

Figure 10:
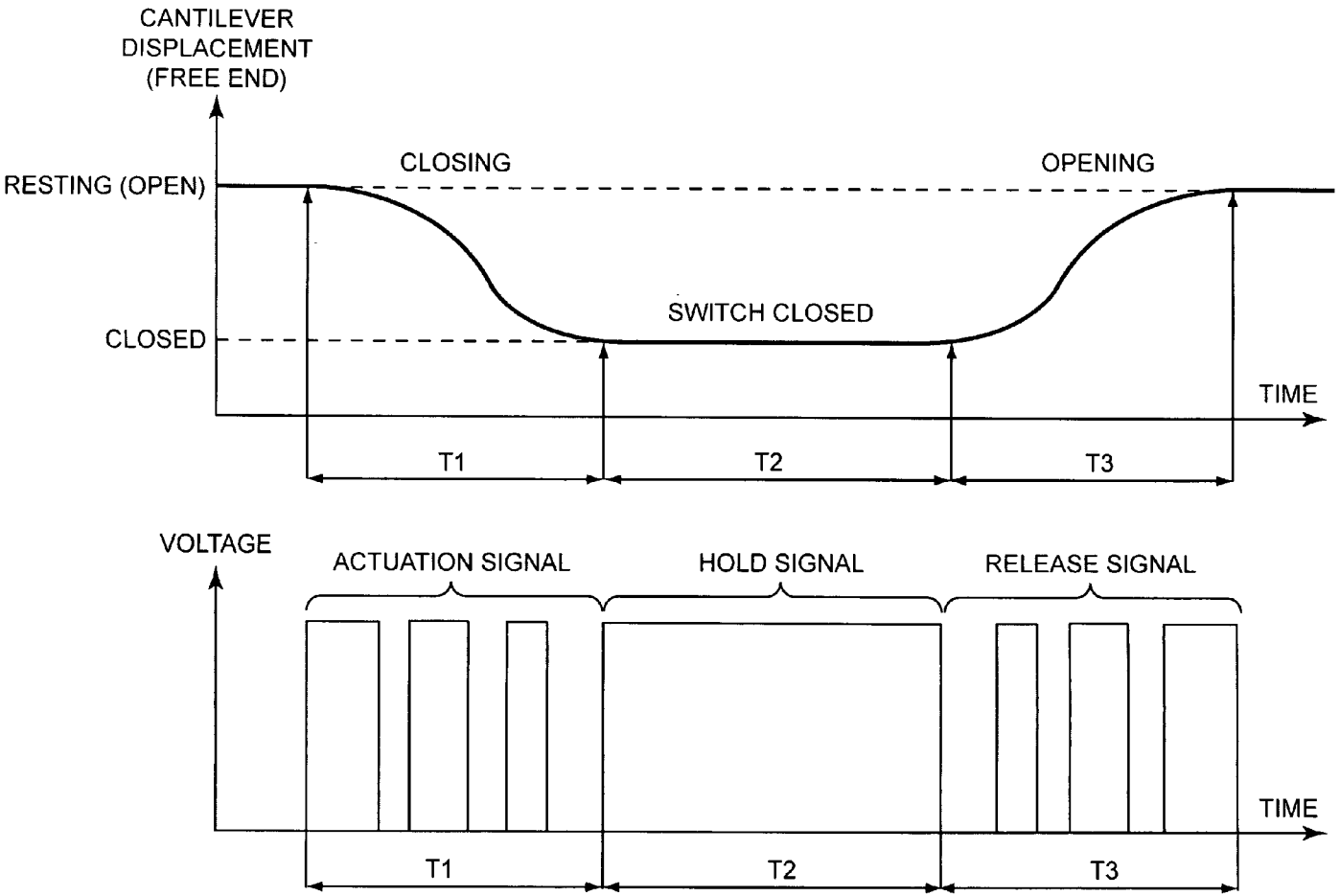

FIG. 10 provides timing diagrams illustrating the position of the free end of a MEMS switch's cantilever in response to successive application of an adaptive actuation signal, a hold signal, and a release signal according to a third embodiment of the present invention.

Figure 2:
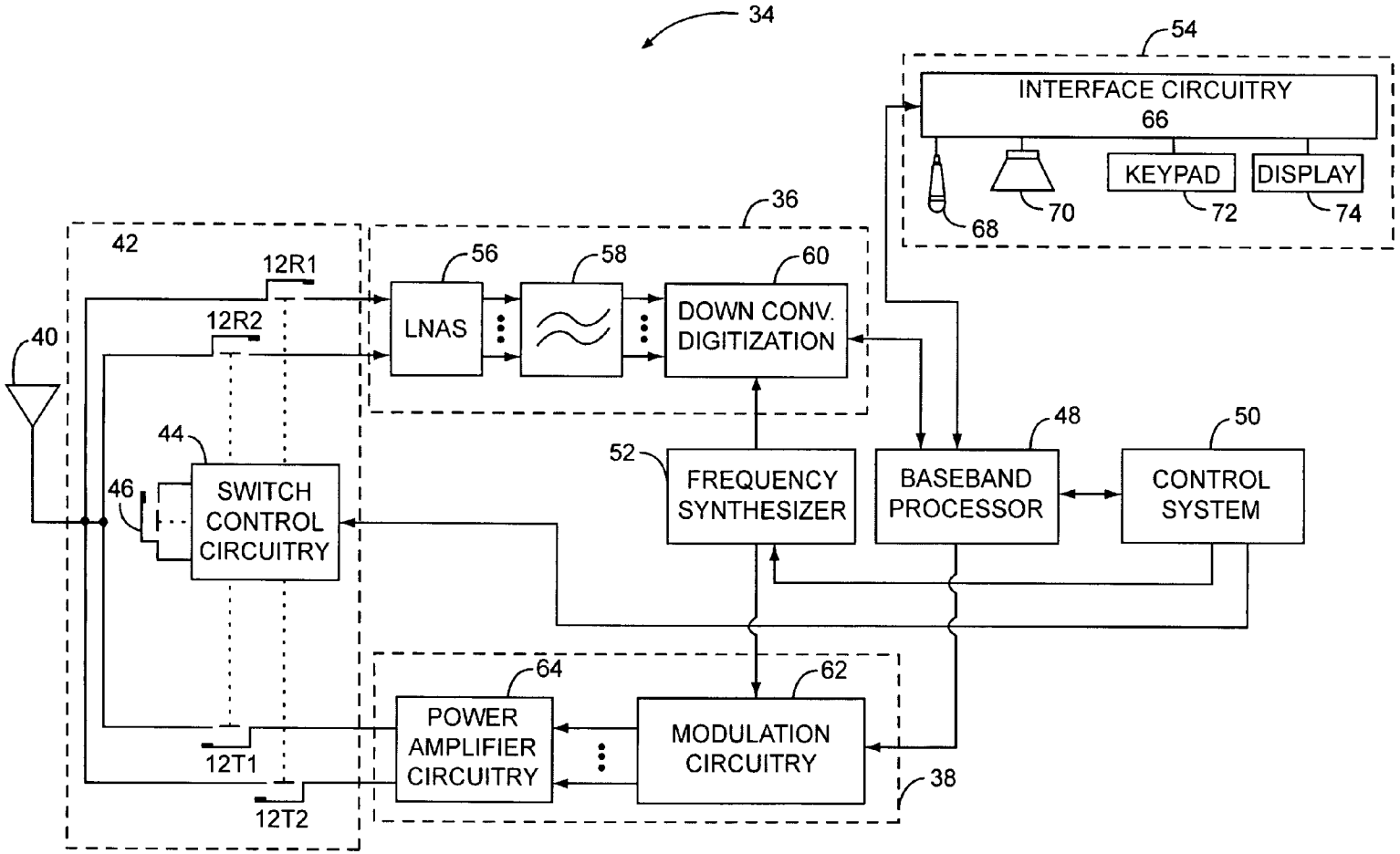
FIG. 2 is a block representation of a mobile terminal according to one embodiment of the present invention.
Figure 11A:
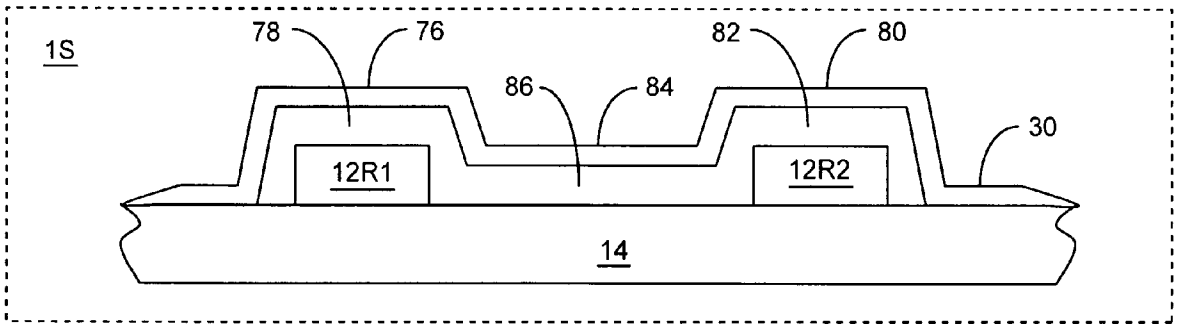

FIG. 11A shows a partial cross-section of the transmit/receive switch illustrated in FIG. 2, according to a first embodiment of the present invention.

Figure 11B:
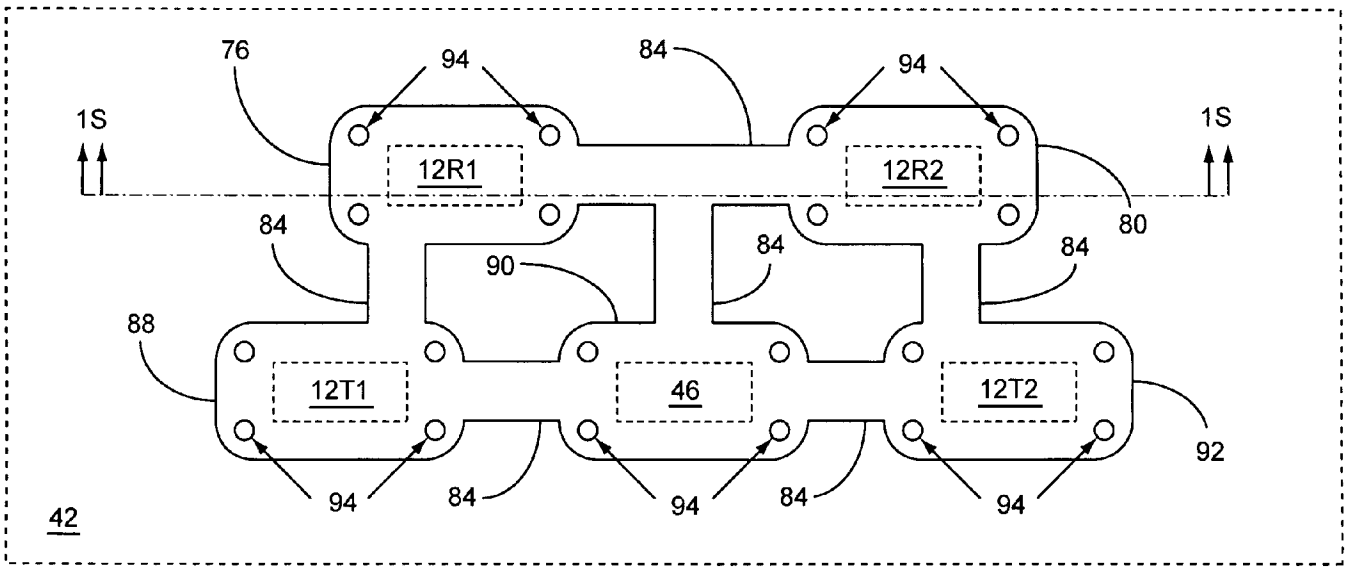

FIG. 11B shows a partial top view of the transmit/receive switch illustrated in FIG. 2, according to the first embodiment of the present invention.

Figure 12:
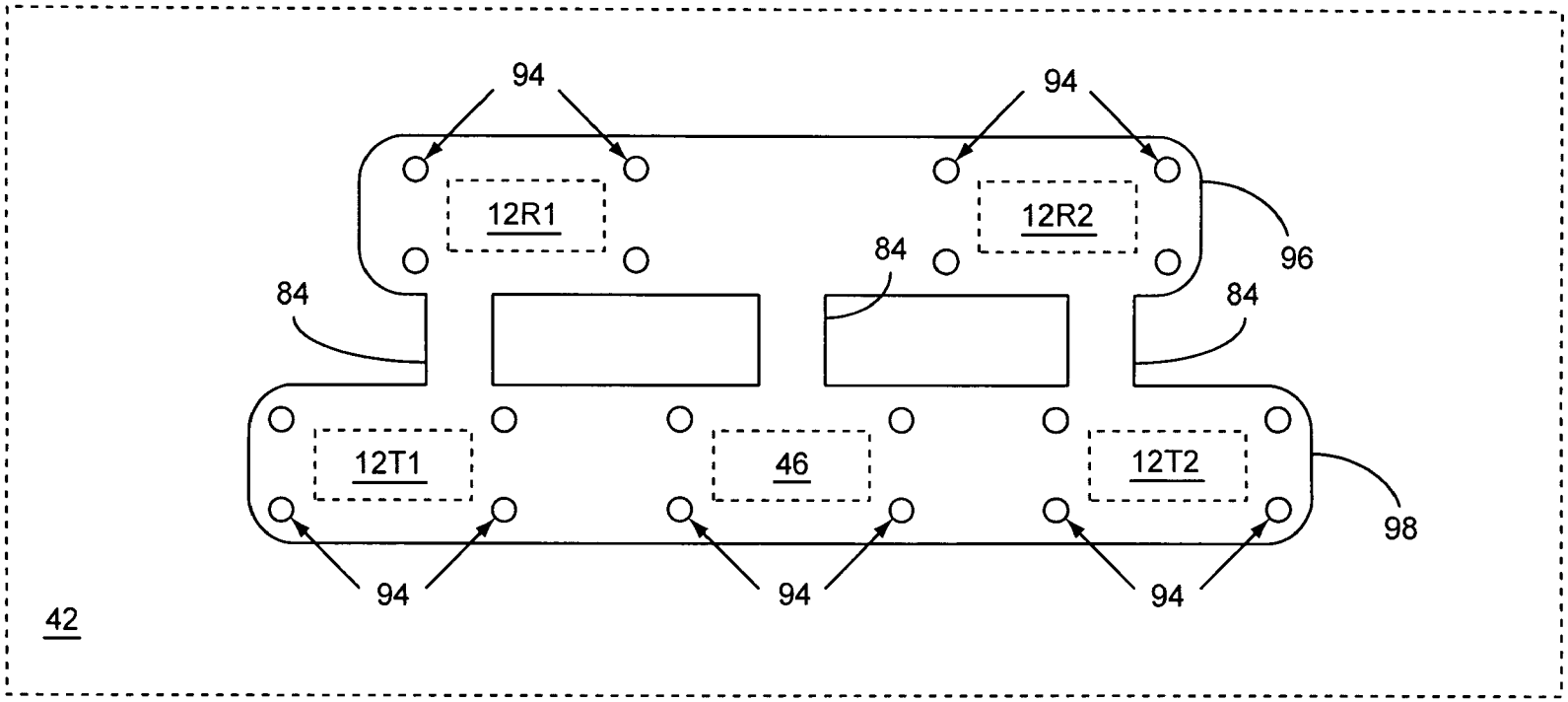

FIG. 12 shows a partial top view of the transmit/receive switch illustrated in FIG. 2, according to a second embodiment of the present invention.

Figure 13:
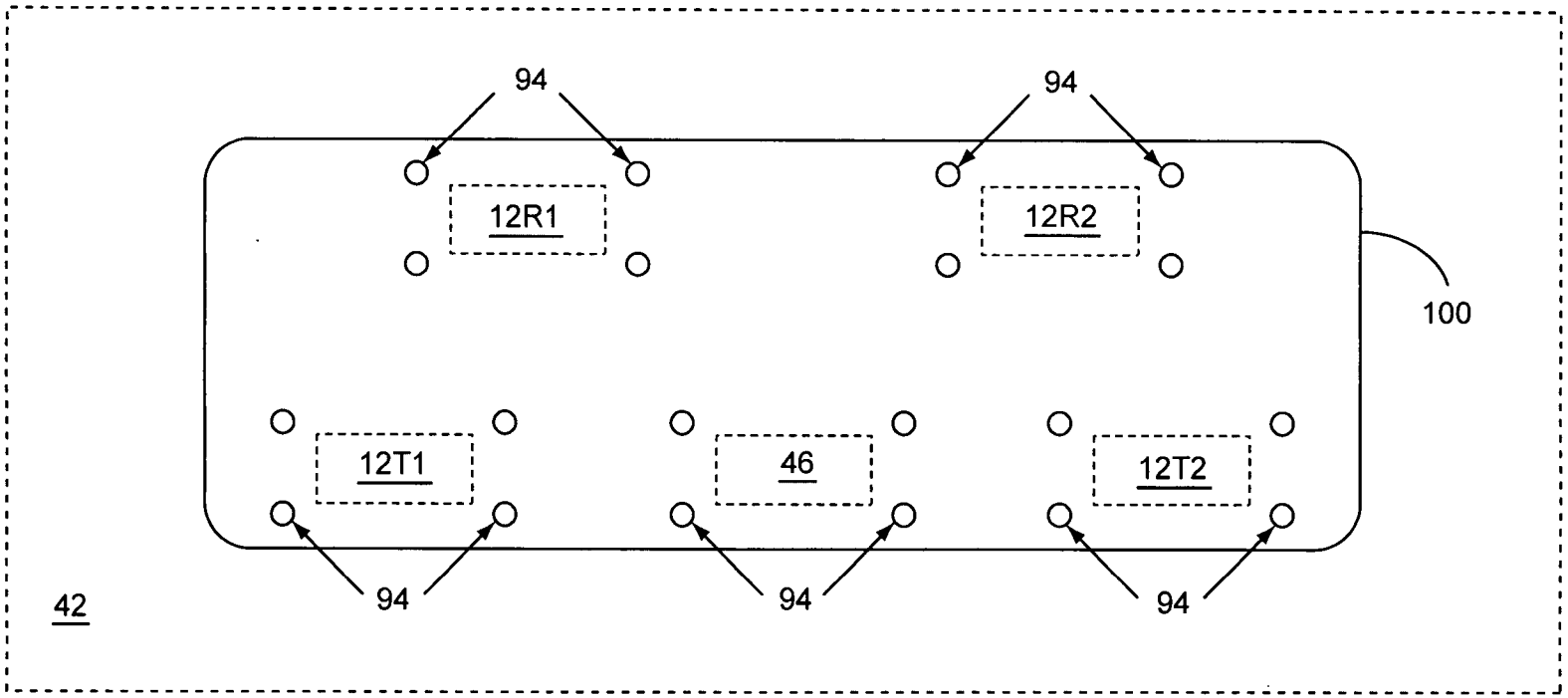

FIG. 13 shows a partial top view of the transmit/receive switch illustrated in FIG. 2, according to a third embodiment of the present invention.

Figure 14:
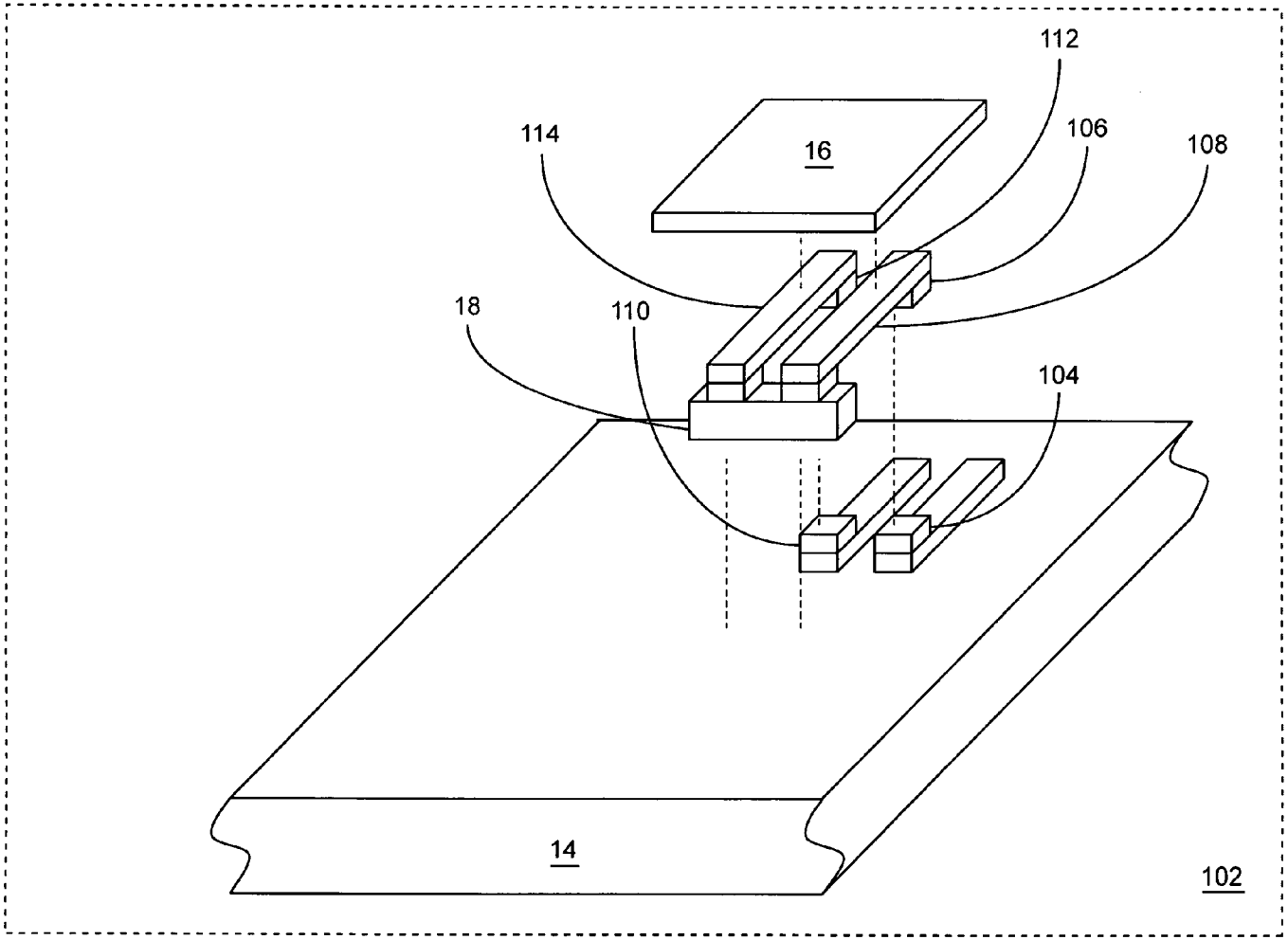

FIG. 14 shows an exploded view of a hybrid cantilever MEMS switch, according to one embodiment of the present invention.

Figure 15:
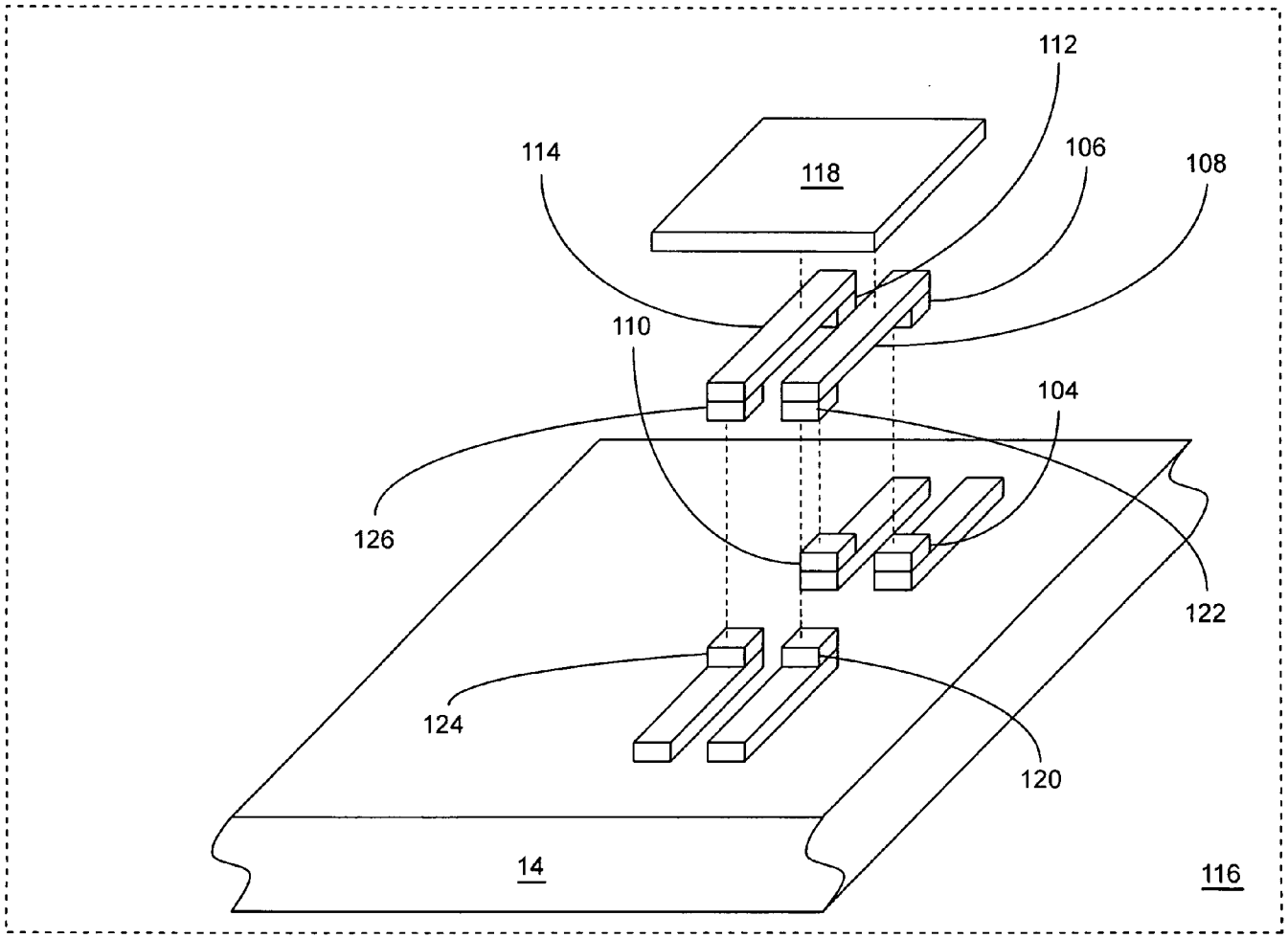

FIG. 15 shows an exploded view of a hybrid floating contact plate MEMS switch, according to another embodiment of the present invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention relates to providing a uniform operating environment for each of multiple devices by providing a common environment to the devices. The common environment is provided by multiple cavities, which are interconnected by at least one environmental pathway, which may be provided by at least one tunnel. The common environment may help provide uniform operating pressure, which may be a partial or near vacuum, a surrounding gas of uniform contents, such as an inert gas or mixture of inert gases, or both. The devices may include micro-electro-mechanical system (MEMS) devices, such as MEMS switches.

The present invention may be incorporated in a mobile terminal, such as a mobile telephone, wireless personal digital assistant, or like communication device, in various ways. In many applications, MEMS switches 12 are being deployed as antenna switches, load switches, transmit/receive switches, tuning switches and the like. FIG. 2 illustrates an exemplary embodiment where numerous MEMS switches 12 are employed in a transmit/receive switch of a mobile terminal 34. Prior to delving into the details of the invention or the illustrated antenna switch, an overview of the basic architecture of the mobile terminal 34 is provided.

As illustrated, the mobile terminal 34 may include a receiver front end 36, a transmitter section 38, an antenna 40, and a transmit/receive switch 42, which includes four active MEMS switches 12R1, 12R2, 12T1, and 12T2, switch control circuitry 44 and a test MEMS switch 46. The mobile terminal 34 is capable of operating in two different bands while using a single antenna 40. As such, both the receiver front end 36 and the radio frequency transmitter section 38 are coupled to the antenna 40 through two different paths. Each path includes one of the active MEMS switches 12R1, 12R2, 12T1, and 12T2.

When receiving in the first band, the active MEMS switch 12R1 is closed, while the other active MEMS switches 12R2, 12T1, and 12T2 are open. When transmitting in the first band, the active MEMS switch 12T1 is closed, while the active MEMS switches 12R1, 12R2, and 12T2 are open. When receiving in the second mode, active MEMS switch 12R2 is closed, while the other active MEMS switches 12R1, 12T1, and 12T2 are open. Similarly, when transmitting in the second mode, active MEMS switch 12T2 is closed while the other active MEMS switches 12R1, 12R2, and 12T1 are open. Thus, signals received by or transmitted from the antenna 40 are selectively routed between the receiver front end 36 and the radio frequency transmitter section 38 based on the selected band. Control of the active MEMS switches 12R1, 12R2, 12T1, and 12T2 is provided by the switch control circuitry 44, which provides actuation signals to the actuator plates 28 (FIGS. 1A and 1B) to provide a soft closing of the active MEMS switch 12, and when the active MEMS switch is closed, provide a hold signal to the actuator plate 28 to effectively hold the active MEMS switch 12 in the closed position. The hold signal is removed from the actuator plate 28 of the active MEMS switch 12 that is closed to allow the active MEMS switch 12 to return to its normal resting (open) position.

Notably, the switch control circuitry 44 is also associated with a test MEMS switch 46. As will be described in greater detail below, the switch control circuitry 44 will use the test MEMS switch 46 to adaptively control the actuation signals provided to the active MEMS switches 12R1, 12R2, 12T1, and 12T2. In particular, the switch control circuitry 44 will determine a test actuator signal that is sufficient to nearly or softly close the test MEMS switch 46 to prevent or minimize bouncing, and then provide actuator signals to close the active MEMS switches 12R1, 12R2, 12T1, and 12T2 based on the test actuator signal. The switch control circuitry 44 will also determine when the test MEMS switch 46 closes relative to the application of the actuation signal. The timing of the hold signal presented to the active MEMS switches 12R1, 12R2, 12T1, and 12T2 is based on when the test MEMS switch 46 closes in response to the same actuation signal.

In addition to adaptively determining an appropriate actuation signal and when to apply a hold signal to the active MEMS switches 12R1, 12R2, 12T1, and 12T2, the switch control circuitry 44 may also provide a release signal, which is configured to reduce or minimize ringing, which is normally associated with a MEMS switch 12 opening from a closed position. When the hold signal is released, a release signal is applied to the actuator plate 28 to substantially suppress ringing of the active MEMS switches 12R1, 12R2, 12T1, and 12T2. Again, further detail relating to controlling bouncing and ringing is provided below after the remaining overview of the basic architecture of the mobile terminal 34.

Continuing with FIG. 2, the mobile terminal 34 further includes a baseband processor 48, a control system 50, a frequency synthesizer 52, and an interface 54. The control system 50 may include or cooperate with the switch control circuitry 44 to control the active MEMS switches 12R1, 12R2, 12T1, and 12T2 to facilitate receiving and transmitting via the different modes as well as help suppress bouncing and ringing of the active MEMS switches 12R1, 12R2, 12T1, and 12T2 during closing and opening, respectively.

The receiver front end 36 receives information bearing radio frequency signals of a given mode from one or more remote transmitters provided by a base station. Low noise amplifiers 56 amplify the signal. Filter circuits 58 minimize broadband interference in the received signal, while downconversion and digitization circuitry 60 downconverts the filtered, received signal to an intermediate or baseband frequency signal, which is then digitized into one or more digital streams. The receiver front end 36 typically uses one or more mixing frequencies generated by the frequency synthesizer 52. The baseband processor 48 processes the digitized received signal to extract the information or data bits conveyed in the received signal. This processing typically comprises demodulation, decoding, and error correction operations. As such, the baseband processor 48 is generally implemented in one or more digital signal processors (DSPs).

On the transmit side, the baseband processor 48 receives digitized data, which may represent voice, data, or control information, from the control system 50, which it encodes for transmission. The encoded data is output to the transmitter section 38, where it is used by modulation circuitry 62 to modulate a carrier signal that is at a desired transmit frequency for the given mode. Power amplifier circuitry 64 amplifies the modulated carrier signal to a level appropriate for transmission according to a power control signal, and delivers the amplified and modulated carrier signal to antenna 40 through the transmit/receive switch 42.

A user may interact with the mobile terminal 34 via the interface 54, which may include interface circuitry 66, which is generally associated with a microphone 68, a speaker 70, a keypad 72, and a display 74. The microphone 68 will typically convert audio input, such as the user's voice, into an electrical signal, which is then digitized and passed directly or indirectly to the baseband processor 48. Audio information encoded in the received signal is recovered by the baseband processor 48, and converted by the interface circuitry 54 into an analog signal suitable for driving the speaker 68. The keypad 72 and display 74 enable the user to interact with the mobile terminal 34, input numbers to be dialed, address book information, or the like, as well as monitor call progress information.

Figure 3:
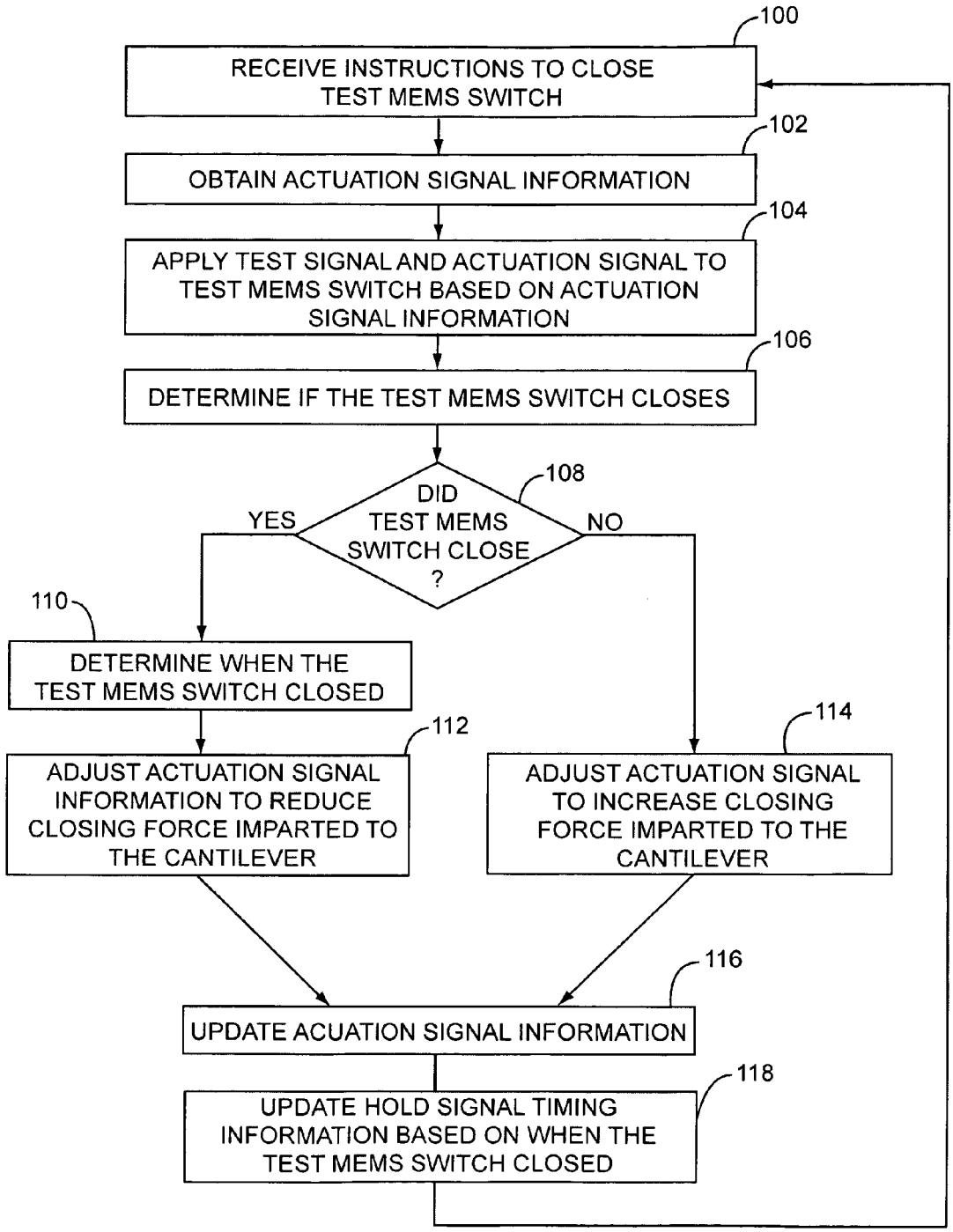
FIG. 3 is a flow diagram illustrating an adaptive process for identifying an appropriate actuation signal according to one embodiment of the present invention.

With reference to FIG. 3, a process is provided for adaptively determining an appropriate actuation signal to use when closing the active MEMS switches 12R1, 12R2, 12T1, and 12T2 based on the closing characteristics of the test MEMS switch 46. Preferably, the test MEMS switch 46 is fabricated on the same semiconductor substrate 14 (FIGS. 1A and 1B) using the same process as used when fabricating the active MEMS switches 12R1, 12R2, 12T1, 12T2, and thus, will tend to perform substantially similarly to the active MEMS switches 12R1, 12R2, 12T1, 12T2. The switch control circuitry 44 is able to present various actuation signals to the test MEMS switch 46, as well as present a test signal across the input and output terminals of the test MEMS switch 46. Thus, the switch control circuitry 44 can detect when the test MEMS switch 46 closes by detecting when the test signal is passed from the input terminal to the output terminal of the test MEMS switch 46. Although these examples relate to normally open MEMS switches, the concepts apply to normally closed MEMS switches, as well as other bi-state or multi-state MEMS switches.

Initially, the switch control circuitry 44 may receive an instruction to close the test MEMS switch 46 from the control system 50 (step 100). The switch control circuitry 44 will obtain initial actuation signal information, which defines the actuation signal to use for closing the test MEMS switch 46 (step 102). Next, the switch control circuitry 44 will apply a test signal at the input terminal of the test MEMS switch 46, and an actuation signal to the control terminal, or actuator plate 28, of the test MEMS switch 46 based on the actuation signal information (step 104). The switch control circuitry 44 will then determine if the test MEMS switch 46 actually closes in response to application of the actuation signal (step 106). If the test MEMS switch 46 closed (step 108), the switch control circuitry will determine when the test MEMS switch 46 closed relative to when the actuation signal was applied (step 110). The switch control circuitry 44 may simply determine the time when the test signal was received at the output terminal of the test MEMS switch 46 relative to the application of the actuation signal to the control input of the test MEMS switch 46. The actuation signal information is then adjusted to effectively reduce the closing energy imparted to the cantilever 16 in response to application of the actuation signal for the next iteration (step 112). An effort is made to modify the actuation signal to reduce the closing energy imparted to the cantilever 16 in response to application of the actuation signal on subsequent closings. As such, the process may be configured to continue to adjust the actuation signal information to effectively reduce the closing energy imparted to the cantilever 16 in response to application of the actuation signal until the cantilever 16 of the test MEMS switch 46 does not close in response to application of the actuation signal.

If the switch control circuitry 44 determines that the test MEMS switch 46 did not close in response to the actuation signal (step 108), the actuation signal information is adjusted to effectively increase the closing energy imparted to the cantilever 16 in response to application of the actuation signal (step 114). As such, through numerous iterations, the actuation signal information is modified in an iterative fashion, wherein on one iteration the test MEMS switch 46 may close in response to the actuation signal, and on the subsequent iteration the test MEMS switch 46 may not close in response to the actuation signal. In either case, this iterative process effectively converges the actuation signal to a configuration that imparts enough energy to cause a soft closing or near closing of the cantilever 16, such that the cantilever contact 22 either gently touches the contact portion 24 of the second conductive plate 26, or stops just shy of the contact portion 24 of the second conductive plate 26. As such, subsequent application of a hold signal would either hold the test MEMS switch 46 in a closed position, or would move the cantilever contact 22 a short distance into contact with the contact portion 24 of the second conductive pad 26, and then hold the test MEMS switch 46 in the closed position. Notably, the short distance traveled by the cantilever contact 22 in response to the hold signal will not cause bouncing or excessive wear to the test MEMS switch 46.

For an active MEMS switch 12R1, 12R2, 12T1, 12T2, it is important to apply the hold signal substantially when the cantilever contact 22 initially contacts the contact portion 24 of the second conductive pad 26, or at a point when the cantilever contact 22 is closest to the contact portion 24 in response to application of the actuation signal. Doing so minimizes the potential for bouncing, and minimizes wear on both the cantilever contact 22 and the contact portion 24 of the second conductive pad 26. As such, the switch control circuitry 44 may continuously update the actuation signal information (step 116) after adjusting the actuation signal to either reduce or increase the closing energy imparted to the cantilever 16 used to close the test MEMS switch 46. The switch control circuitry 44 may also update the hold signal timing information, if available, based on when the test MEMS switch 46 closed relative to application of the actuation signal to the test MEMS switch 46 (step 118). As noted, this process will repeat to allow the switch control circuitry 44 to adaptively converge on actuation signal information that will produce an actuation signal that provides a soft or near closing of the test MEMS switch 46, as well as determine when the test MEMS switch 46 closes in response to application of the actuation signal.

Based on the actuation signal information and the hold signal timing information derived from operating the test MEMS switch 46, the switch control circuitry 44 will operate to apply the actuation signal based on the actuation signal information and subsequently apply a hold signal based on the hold signal timing information to a selected one or ones of the active MEMS switches 12R1, 12R2, 12T1, 12T2 during normal operation of the mobile terminal 34. Since the test MEMS switch 46 should have the same operating characteristics as the active MEMS switches 12R1, 12R2, 12T1, 12T2 due to their common fabrication characteristics and environment, the actuation signal and timing for applying the hold signal can be applied to the active MEMS switches 12R1, 12R2, 12T1, 12T2 to minimize bouncing and wear.

The iterative process provided in FIG. 3 may be implemented in various ways. For example, the process may be employed such that multiple iterations are employed to arrive at desired actuation signal information and hold signal timing information prior to operating any of the active MEMS switches 12R1, 12R2, 12T1, 12T2. Thus, initial operation of the active MEMS switches 12R1, 12R2, 12T1, 12T2 will use relatively optimized actuation signals, and the subsequent hold signals will be applied at a relatively optimized time in light of the hold signal timing information. In operation, every time a mode is selected or the mobile terminal 34 is powered on, the iterative process to obtain an optimal actuation signal and time for applying a hold signal is generated prior to initiating communications.

Alternatively, the switch control circuitry 44 may run the process in real time during operation of the mobile terminal 34, wherein the switch control circuitry 44 effectively applies an actuation signal based on the current actuation signal information to close the test MEMS switch 46 as well as any selected active MEMS switches 12R1, 12R2, 12T1, 12T2. In other words, the test MEMS switch 46 is closed when one of the active MEMS switches 12R1, 12R2, 12T1, 12T2 is closed. The switch control circuitry 44 will constantly adapt to existing conditions to ensure that the test MEMS switch 46 is coming to a near or soft close, adjust the actuation signal information as necessary, and provide an actuation signal based on the updated actuation signal information the next time an active MEMS switch 12R1, 12R2, 12T1, 12T2 (and perhaps the test MEMS switch 46) is closed. Additionally, the hold signal timing information is updated along with updating the actuation signal information such that the hold signal applied to the active MEMS switches 12R1, 12R2, 12T1, 12T2 tracks the updates for the actuation signal.

Notably, the actuation signal information and the hold signal timing information may be updated with every closing of any of the active MEMS switches 12R1, 12R2, 12T1, 12T2, or may be updated on a periodic basis after a certain number of closings or after a certain amount of time has passed. Thus, the process outlined in FIG. 3 may cycle through a given iteration every so many closings or after a certain amount of time. In such an embodiment, if the actuation signal information is far from optimal, the first few iterations of the process may result in significant bouncing. However, after a few iterations, a more optimal actuation signal and hold signal timing will be determined.

Turning to FIG. 4, timing diagrams are provided to illustrate the displacement of the cantilever 16 in light of application of an actuation signal and a subsequent hold signal according to one embodiment of the present invention. Notably, the cantilever displacement corresponds directly to the relative position of the cantilever contact 22 over the contact portion 24 of the second conductive pad 26. FIG. 4 is best described in association with the flow diagram of FIG. 5, which outlines the process for closing an active MEMS switch 12R1, 12R2, 12T1, 12T2. Initially, the active MEMS switch 12R1, 12R2, 12T1, 12T2 is open, and thus the cantilever 16 is in an open position. The switch control circuitry 44 will receive an instruction to close the active MEMS switch 12R1, 12R2, 12T1, 12T2 (step 200), and will apply an actuation signal to the active MEMS switch 12R1, 12R2, 12T1, 12T2 based on the actuation signal information, which was derived from the test MEMS switch 46 (step 202). The actuation signal illustrated in FIG. 4 includes a fixed voltage pulse for a time T1 followed by a rest period for time T2, wherein no voltage is applied to the control terminal or actuator plate 28. As illustrated, during time T1 where the pulse is being applied to the control terminal, the cantilever 16 begins to move downward at an increasingly rapid rate. When the voltage is removed from the control terminal during time T2, the downward movement of the cantilever 16 decreases and comes to a stop at a point where the cantilever contact 22 is just above the contact portion 24 of the second conductive pad 26, or the cantilever contact 22 comes into contact with the contact portion 24 of the second conductive pad 26 at the end of time T2. At the end of the actuation signal, the hold signal is applied for a time T3 (step 204). Application of the hold signal is based on the hold signal timing derived from the test MEMS switch 46.

In an alternate embodiment of the present invention, instead of the actuation signal having a fixed voltage pulse for a time T1 followed by a rest period for time T2, the activation signal may have multiple stepped pulses of different voltages (or currents) over the time T1, may have a continuously variable voltage (or current) over the time T1, may follow the active time T1 with the rest period, may omit the rest period, or any combination thereof.

Unfortunately, the closing of a MEMS switch 12 is not the only problematic aspect of operating the MEMS switch 12. As indicated above, opening the MEMS switch 12, and in particular releasing the cantilever 16 from a closed position by removing the hold signal, causes the free end of the cantilever 16 to mechanically oscillate, or ring. This ringing often lasts for an extended period of time, which may be longer than the time between closings. Thus, an actuation signal that is appropriate to close the MEMS switch 12 when the cantilever 16 is at rest will likely not be sufficient to provide a near or soft closing of the MEMS switch 12 when the cantilever 16 is still oscillating from a recent opening.

With reference to FIG. 6, the mechanical displacement of the free end of the cantilever 16 is illustrated after releasing a hold signal to allow a closed MEMS switch 12 to return to a normal resting position, which is an open position in the illustrated embodiments. As illustrated, the free end of the cantilever 16 begins in a closed position, and oscillates well above the normal resting (open) position of the cantilever 16. These oscillations continue such that the free end of the cantilever 16 oscillates above and below the normal resting (open) position. During operation, the position and movement associated with the cantilever 16 during these oscillations drastically change the response of the MEMS switch 12 to an otherwise appropriate actuation signal. Accordingly, another aspect of the present invention provides a release signal after the hold signal is removed in order to dampen the ringing normally associated with releasing a MEMS switch 12 from a closed position.

Returning to the exemplary embodiment illustrated in FIG. 2 along with reference to FIG. 7, a technique is presented to significantly reduce or eliminate ringing after a hold signal has been removed from one of the active MEMS switches 12R1, 12R2, 12T1, 12T2. Initially, the switch control circuitry 44 will receive an instruction to release one of the active MEMS switches 12R1, 12R2, 12T1, 12T2 from a closed position (step 300). The switch control circuitry 44 will then remove the hold signal from the active MEMS switch 12R1, 12R2, 12T1, 12T2 (step 302) and then apply a release signal to the active MEMS switch 12R1, 12R2, 12T1, 12T2 (step 304). The release signal is applied to the control input of the active MEMS switch 12R1, 12R2, 12T1, 12T2 and is configured to apply significant down force to the cantilever 16 to reduce the speed at which the cantilever 16 springs back toward the resting position. The release signal will not pull the cantilever 16 downward, but will instead simply slow the rate at which the cantilever 16 moves upward, such that the free end of the cantilever 16 does not significantly overshoot its normal resting position, and thus, significantly reduces or eliminates any mechanical oscillation of the free end of the cantilever 16. Thus, ringing is at worst reduced to a point where subsequent switch closings occur after any ringing is abated or reduced to a point of insignificance.

Like the actuation signal, the release signal may take various forms and may have portions wherein a voltage (or current) may be applied during release time, and no voltage (or current) may be applied at another portion of the opening time. With reference to FIG. 8, an exemplary release signal is illustrated along with the corresponding cantilever displacement. The application of the actuation signal and the subsequent hold signal is the same as that described in association with FIG. 4. When the hold signal is removed at the end of time T3 and the beginning of time T4, the release signal is applied. In this example, there is no voltage (or current) applied during time T4; however, at the end of time T4 and beginning of time T5, a pulse is applied for the remaining portion of the release signal. As such, the free end of the cantilever 16 will begin rising quickly when the hold signal is removed and throughout time T4. During time T5, the voltage is applied at the control input of the active MEMS switch 12R1, 12R2, 12T1, 12T2, and thus a down force is applied against the rising cantilever 16. The effect of the down force is sufficient to allow the cantilever 16 to decelerate as it approaches its normal resting position, thus minimizing ringing.

In this example, the release signal is effectively a mirror image of the actuation signal. Applicants' research has found that, in the case of a near vacuum environment for the cantilever, applying a mirror image of an appropriate actuation signal as a release signal is sufficient to significantly decrease, if not eliminate, oscillations after removing a hold signal.

With reference to FIGS. 9 and 10, various actuation signal profiles and corresponding release signals, which are effectively and substantially mirror images of the actuation signals, are illustrated. Those skilled in the art will recognize that the release signal does not have to be a mirror image of the actuation signal that is applied to close a MEMS switch 12; however, in one embodiment of the present invention, using a mirror image of the actuation signal as a release signal is an effective way of arriving at an appropriate release signal. Further, it is much easier to determine and select an actuation signal that provides a near or soft closing, because one can monitor when the MEMS switch 12 actually closes. When releasing a hold signal to open a MEMS switch 12, it is difficult to determine when ringing has substantially abated. Thus, basing the release signal on the actuation signal allows the release signal to be adapted to various environmental and process variations when used in conjunction with the adaptive actuation signal generation of one embodiment of the present invention.

With particular reference to FIG. 9, the actuation signal provides a fixed voltage (or current) during a time T1, and during time T2 a decaying voltage is applied until or slightly before a hold signal is applied at the end of time T2 and beginning of time T3. Correspondingly, the release signal begins during time T4 with an increasing voltage (or current) until the beginning of time T5, wherein a fixed voltage (or current) is applied throughout time T5. Notably, the magnitudes of the actuation signal, release signal, and hold signal may vary, if desired, in embodiments where analog signals are available. In digital control embodiments, the voltages (currents) applied throughout the actuation signal, hold signal, and release signal are preferably at the same level.

With reference to FIG. 10, a series of pulses such as those that may be provided during pulse width modulation (PWM) may make up the actuation signal or release signal. In FIG. 10, the actuation signal includes a series of three pulses provided during a time T1, wherein each pulse is followed by a period of no voltage (or current), and each successive pulse has a decreasing duration. Correspondingly, the release signal includes a series of pulses with increasing durations, which are spaced apart during time T3.

FIG. 11A shows a partial cross-section 1S of the transmit/receive switch 42 illustrated in FIG. 2, according to a first embodiment of the present invention. The first and second active MEMS receive switches 12R1, 12R2 are attached to the substrate 14. The one or more encapsulating layers 30 are used to provide a first MEMS encapsulating dome 76, which forms a first cavity 78 around the first active MEMS receive switch 12R1, and a second MEMS encapsulating dome 80, which forms a second cavity 82 around the second active MEMS receive switch 12R2. A MEMS tunnel 84 interconnects the first and second MEMS encapsulating domes 76, 80 and provides an environmental pathway 86 between the first and second cavities 78, 82. The first and second cavities 78, 82 and the environmental pathway 86 may provide a common environment for the first and second active MEMS receive switches 12R1, 12R2. Therefore a pressure difference between the first and second cavities 78, 82 may be about zero. The common environment may help provide uniform operating pressure, which may be a partial or near vacuum, a surrounding gas of uniform contents, such as an inert gas or mixture of inert gases, or both. The surrounding gas may include Nitrogen, Helium, Neon, Argon, Krypton, Xenon, or any combination thereof. The first and second MEMS encapsulating domes 76, 80 may be sealed to the substrate 14, either directly or through intervening layers, to substantially prevent entrance or escape of gas. In one embodiment of the present invention, the volume of the first cavity 78 may be substantially larger than the volume of the environmental pathway 86. In an exemplary embodiment of the present invention, the volume of the first cavity 78 may be more than two times larger than the volume of the environmental pathway 86. The environmental pathway 86 may be elongated.

FIG. 11B shows a partial top view of the transmit/receive switch 42 illustrated in FIG. 2, according to the first embodiment of the present invention. In addition to the first and second MEMS encapsulating domes 76, 80 providing the first and second cavities 78, 82 for the first and second active MEMS receive switches 12R1, 12R2, a third MEMS encapsulating dome 88 provides a third cavity (not shown) for the first active MEMS transmit switch 12T1, a fourth MEMS encapsulating dome 90 provides a fourth cavity (not shown) for the test MEMS switch 46, and a fifth MEMS encapsulating dome 92 provides a fifth cavity (not shown) for the second active MEMS transmit switch 12T2. MEMS tunnels 84 interconnect the first, second, third, fourth, and fifth MEMS encapsulating domes 76, 80, 88, 90, 92 and provide environmental pathways (not shown) between the first, second, third, fourth, and fifth cavities (not shown). The environmental pathways and the first, second, third, fourth, and fifth cavities provide a common environment for the active MEMS switches 12R1, 12R2, 12T1, 12T2 and the test MEMS switch 46. Alternate embodiments of the present invention may use multiple test MEMS switches 46.

The first, second, third, fourth, and fifth MEMS encapsulating domes 76, 80, 88, 90, 92 may be formed using a sacrificial layer (not shown), which is formed over the active MEMS switches 12R1, 12R2, 12T1, 12T2 and the test MEMS switch 46. An encapsulating layer 30, which may include Silicon Nitride or Silicon Dioxide, may be formed over the sacrificial layer to form the first, second, third, fourth, and fifth MEMS encapsulating domes 76, 80, 88, 90, 92. Evacuation holes 94 may be opened in the encapsulating layer 30 over the first, second, third, fourth, and fifth MEMS encapsulating domes 76, 80, 88, 90, 92, in the MEMS tunnels 84, or both, and the sacrificial layer may be removed, thereby forming the first, second, third, fourth, and fifth cavities. One or more additional encapsulating layers 30 may be added to plug the evacuation holes 94, to strengthen the first, second, third, fourth, and fifth MEMS encapsulating domes 76, 80, 88, 90, 92, or both. The one or more additional encapsulating layers 30 may include Silicon Nitride, Silicon Dioxide, or both. The common environment, which may include a partial vacuum, one or more gases, or both, may be provided as a by-product of the encapsulation process. Alternate embodiments of the present invention may provide the environmental pathway 86 using the one or more additional encapsulating layers 30, using the substrate 14, using one or more metallization layers, using one or more epitaxial layers, or any combination thereof.

FIG. 12 shows a partial top view of the transmit/receive switch 42 illustrated in FIG. 2, according to a second embodiment of the present invention. Instead of the first, second, third, fourth, and fifth MEMS encapsulating domes 76, 80, 88, 90, 92 providing the first, second, third, fourth, and fifth cavities, a first multi-MEMS encapsulating dome 96 provides a first multi-MEMS cavity (not shown) around the first and second active MEMS receive switches 12R1, 12R1, and a second multi-MEMS encapsulating dome 98 provides a second multi-MEMS cavity (not shown) around the first and second active MEMS transmit switches 12T1, 12T2 and the test MEMS switch 46. MEMS tunnels 84 interconnect the first and second multi-MEMS encapsulating domes 96, 98 and provide environmental pathways (not shown) between the first and second multi-MEMS cavities (not shown).

FIG. 13 shows a partial top view of the transmit/receive switch 42 illustrated in FIG. 2, according to a third embodiment of the present invention. Instead of the first, second, third, fourth, and fifth MEMS encapsulating domes 76, 80, 88, 90, 92 providing the first, second, third, fourth, and fifth cavities, a common MEMS encapsulating dome 100 provides a common cavity (not shown) around the active MEMS switches 12R1, 12R2, 12T1, 12T2 and the test MEMS switch 46 to provide the common environment.

FIG. 14 shows an exploded view of a hybrid cantilever MEMS switch 102, according to one embodiment of the present invention. The hybrid cantilever MEMS switch 102 combines the functionality of the test MEMS switch 46 and one of the active MEMS switches 12R1, 12R2, 12T1, 12T2 into a single MEMS switch. The hybrid cantilever MEMS switch 102 includes the cantilever 16, the anchor 18, a first stationary test contact 104, which may attached to the substrate 14 through contact material, a first movable test contact 106, which may be attached to the cantilever 16 through first contact material 108, a first stationary active contact 110, which may attached to the substrate 14 through contact material, and a first movable active contact 112, which may be attached to the cantilever 16 through second contact material 114. The anchor 18 attaches one end of the cantilever 16, one end of the first contact material 108, and one end of the second contact material 114 to the substrate 14. The hybrid cantilever MEMS switch 102 may be actuated in a similar manner to the MEMS switch 12 illustrated in FIGS. 1A and 1B. The first stationary test contact 104 and the first movable test contact 106 may form a first test contact pair. The first stationary active contact 110 and the first movable active contact 112 may form a first active contact pair. In some embodiments of the present invention, the first contact material 108 and the second contact material 114 may be merged with the cantilever 16, which may reduce utility for having separated contacts; however, the fabrication process may be simplified.

FIG. 15 shows an exploded view of a hybrid floating contact plate MEMS switch 116, according to another embodiment of the present invention. The hybrid floating contact plate MEMS switch 116 combines the functionality of the test MEMS switch 46 and one of the active MEMS switches 12R1, 12R2, 12T1, 12T2 into a single MEMS switch. The hybrid floating contact plate MEMS switch 116 includes a floating contact plate 118, the first stationary test contact 104, which may attached to the substrate 14 through contact material, the first movable test contact 106, which may be attached to the floating contact plate 118 through the first contact material 108, the first stationary active contact 110, which may attached to the substrate 14 through contact material, and the first movable active contact 112, which may be attached to the floating contact plate 118 through second contact material 114. Additionally, the hybrid floating contact plate MEMS switch 116 includes a second stationary test contact 120, which may attached to the substrate 14 through contact material, a second movable test contact 122, which may be attached to the floating contact plate 118 through the first contact material 108, a second stationary active contact 124, which may attached to the substrate 14 through contact material, and a second movable active contact 126, which may be attached to the floating contact plate 118 through the second contact material 114.

Figure 1A:
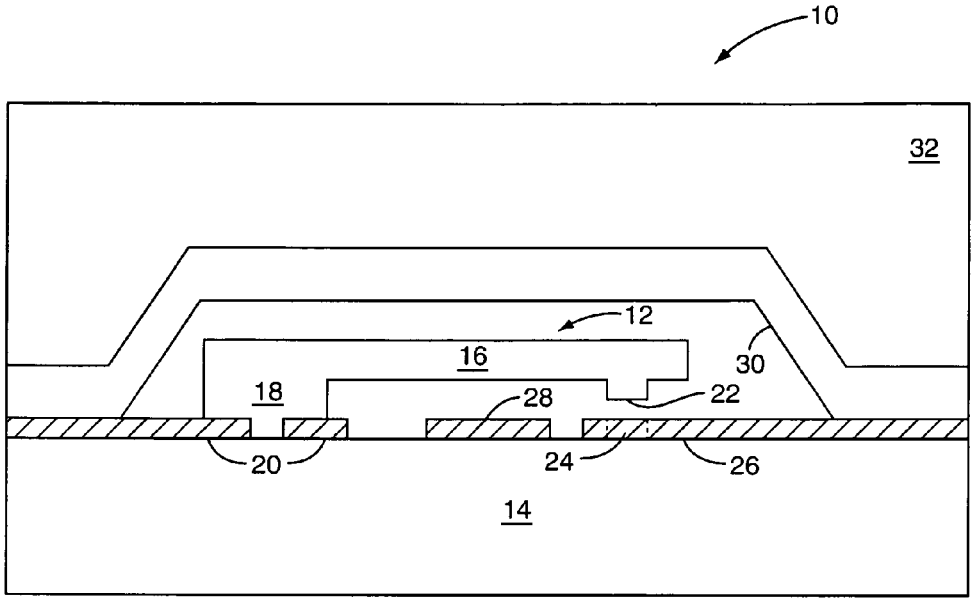
FIGS. 1A and 1B illustrate an exemplary micro-electro-mechanical system (MEMS) switch in a resting and closed position, respectively.
Figure 1B:
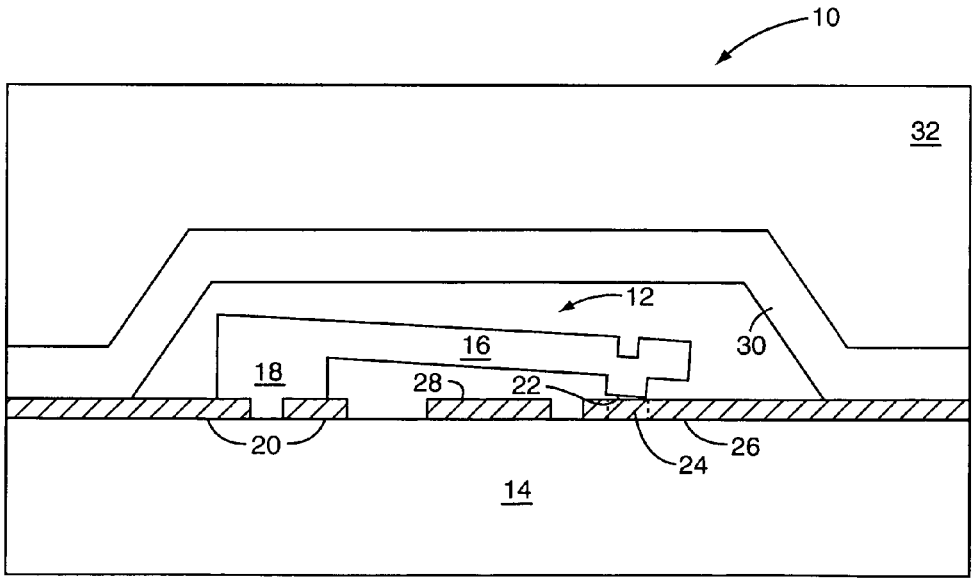

The hybrid floating contact plate MEMS switch 116 may be actuated in a similar manner to the MEMS switch 12 illustrated in FIGS. 1A and 1B. The first stationary test contact 104 and the first movable test contact 106 may form the first test contact pair. The second stationary test contact 120 and the second movable test contact 122 may form a second test contact pair. The first stationary active contact 110 and the first movable active contact 112 may form the first active contact pair. The second stationary active contact 124 and the second movable active contact 126 may form a second active contact pair.

When the hybrid floating contact plate MEMS switch 116 is open, the first stationary test contact 104 is not in electrical contact with the first movable test contact 106, the second stationary test contact 120 is not in electrical contact with the second movable test contact 122, the first stationary active contact 110 is not in electrical contact with the first movable active contact 112, and the second stationary active contact 124 is not in electrical contact with the second movable active contact 126. Conversely, when the hybrid floating contact plate MEMS switch 116 is closed, the first stationary test contact 104 is in electrical contact with the first movable test contact 106, the second stationary test contact 120 is in electrical contact with the second movable test contact 122, the first stationary active contact 110 is in electrical contact with the first movable active contact 112, and the second stationary active contact 124 is in electrical contact with the second movable active contact 126. Therefore, the first stationary test contact 104 is electrically connected to the second stationary test contact 120 through the first movable test contact 106, through the first contact material 108, and through the second movable test contact 122. Similarly, the first stationary active contact 110 is electrically connected to the second stationary active contact 124 through the first movable active contact 112, through the second contact material 114, and through the second movable active contact 126. Using a floating contact plate 118 may be mechanically and electrically advantageous for multiple contact pair MEMS switches, when compared with using a cantilever 16.

Those skilled in the art will recognize various ways in which to configure actuation and release signals in light of the teachings herein. These variations are considered within the scope of this disclosure and the claims that follow. Further, the adaptive process for determining actuation signals does not need to be combined with the use of release signals to minimize ringing. Similarly, a release signal may be used in an embodiment where the actuation signal is fixed, and not adapted in light of environmental and process variations.

Those skilled in the art will recognize improvements and modifications to the preferred embodiments of the present invention. All such improvements and modifications are considered within the scope of the concepts disclosed herein and the claims that follow.

What is claimed is:

1. A system comprising:

a first encapsulating structure;

a second encapsulating structure attached and substantially sealed to the first encapsulating structure to form a plurality of cavities between the first encapsulating structure and the second encapsulating structure to provide a common environment to a plurality of micro-electro-mechanical system (MEMS) switches;

at least one environmental pathway interconnecting the plurality of cavities to provide the common environment to each of the plurality of MEMS switches; and the plurality of MEMS switches.

2. The system of claim 1 wherein at least one of the plurality of MEMS switches is in one of the plurality of cavities and at least one other of the plurality of MEMS switches is in another of the plurality of cavities.

3. The system of claim 1 wherein a pressure difference between two of the plurality of cavities is about zero.

4. The system of claim 1 wherein the common environment comprises a partial vacuum.

5. The system of claim 1 wherein the common environment comprises a gas.

6. The system of claim 5 wherein the gas comprises an inert gas.

7. The system of claim 5 wherein the gas is substantially provided as a by-product of an encapsulation process.

8. The system of claim 1, wherein the plurality of MEMS switches comprises at least one MEMS radio frequency (RF) switch.

9. The system of claim 1, wherein the plurality of MEMS switches comprises at least one test MEMS switch and at least one active MEMS switch.

10. The system of 1, wherein at least one of the plurality of MEMS switches comprises at least one hybrid MEMS switch comprising at least one pair of test contacts and at least one pair of active contacts.

11. The system of claim 1, further comprising switch control circuitry wherein:

the system is adapted to provide an actuation signal to apply when closing MEMS switches;

the plurality of MEMS switches comprises a first MEMS switch;

the plurality of MEMS switches further comprises a second MEMS switch that was formed using the same process as the first MEMS switch; and the switch control circuitry is adapted to:

iteratively determine the actuation signal required to cause a near closing or soft closing of the first MEMS switch that resides in an electronic circuit; and effect closing of the second MEMS switch that resides in the electronic circuit by applying the actuation signal to the second MEMS switch and subsequently applying a hold signal to the second MEMS switch to maintain the second MEMS switch in a closed position, wherein the actuation signal used to close the second MEMS switch is repeatedly updated based on operation of the first MEMS switch.

12. The system of claim 11 wherein in association with iteratively determining the actuation signal, the switch control circuitry is further adapted to determine a closing time identifying a time at which the near closing or soft closing occurs in the first MEMS switch relative to application of the actuation signal, wherein effecting closing of the second MEMS switch is afforded by applying the actuation signal to the second MEMS switch and subsequently applying the hold signal to the second MEMS switch at the closing time to maintain the second MEMS switch in the closed position.

13. The system of claim 11 wherein to iteratively determine the actuation signal to cause the near closing or soft closing of the first MEMS switch, the switch control circuitry is further adapted to:

apply the actuation signal to a control terminal of the first MEMS switch;

determine whether the first MEMS switch closes in response to application of the actuation signal;

adjust the actuation signal to impart greater closing energy, if the first MEMS switch does not close in response to the actuation signal; and adjust the actuation signal to provide less closing energy, if the first MEMS switch closes in response to application of the actuation signal.

14. The system of claim 1, further comprising switch control circuitry wherein:

the system is adapted to control movement of a MEMS switch from a closed position to reduce ringing;

the plurality of MEMS switches comprises a first MEMS switch; and the switch control circuitry is associated with the first MEMS switch and adapted to:

apply a hold signal to the first MEMS switch to maintain a movable portion of the first MEMS switch in the closed position, wherein when no signal is applied to the first MEMS switch, the movable portion of the first MEMS switch is normally in a resting position;

remove the hold signal from the first MEMS switch to initiate returning of the first MEMS switch to the resting position; and after removing the hold signal, apply to the first MEMS switch a release signal configured to retard a rate at which the movable portion of the first MEMS switch approaches the resting position sufficiently to avoid significant mechanical oscillations of the movable portion of the first MEMS switch after removal of the hold signal.

15. The system of claim 14 wherein the release signal comprises a first signal period having a first voltage or current waveform followed by a second signal period having a second voltage or current waveform that is different from the first voltage or current waveform.

16. The system of claim 14 wherein the release signal comprises a first no signal period having no voltage or current waveform followed by a second signal period having a voltage or current waveform.

17. The system of claim 1, wherein:

the first encapsulating structure comprises a substrate; and the second encapsulating structure comprises a plurality of MEMS encapsulating domes over the plurality of MEMS switches to provide the plurality of cavities.

18. The system of claim 17 wherein at least one of the plurality of MEMS switches is in one of the plurality of cavities and at least one other of the plurality of MEMS switches is in another of the plurality of cavities.

19. The system of claim 17 wherein at least one of the plurality of MEMS switches is in one of the plurality of cavities and at least two other of the plurality of MEMS switches is in another of the plurality of cavities.

20. The system of claim 17 wherein a semiconductor die provides the substrate.

21. The system of claim 17 wherein the plurality of MEMS encapsulating domes is substantially sealed to the substrate to substantially prevent entrance or escape of gas.

22. The system of claim 1, wherein the plurality of MEMS switches is in one of the plurality of cavities and at least one of the plurality of MEMS switches is in another of the plurality of cavities.

23. The system of claim 1, further comprising at least one tunnel interconnecting at least one pair of the plurality of cavities to provide the at least one environmental pathway.

24. The system of claim 1 wherein at least one of the plurality of MEMS switches is in one of the plurality of cavities and at least two other of the plurality of MEMS switches is in another of the plurality of cavities.

25. The system of claim 1 wherein a volume of each of the plurality of MEMS switches is substantially larger than a volume of each of the at least one environmental pathway.

26. The system of claim 1 wherein a volume of each of the plurality of MEMS switches is at least two times larger than a volume of each of the at least one environmental pathway.

27. The system of claim 1 wherein each of the at least one environmental pathway is elongated.

28. A system comprising:

a first encapsulating structure; and a second encapsulating structure attached and substantially sealed to the first encapsulating structure to form a plurality of cavities between the first encapsulating structure and the second encapsulating structure to provide a common environment to a plurality of micro-electro-mechanical system (MEMS) switches; and the plurality of devices; and wherein the system is adapted to provide an actuation signal to apply when closing MEMS switches; and wherein the plurality of MEMS switches comprises a first MEMS switch;

wherein the plurality of MEMS switches further comprises a second MEMS switch that was formed using the same process as the first MEMS switch; and wherein the switch control circuitry is adapted to:

iteratively determine the actuation signal required to cause a near closing or soft closing of the first MEMS switch that resides in an electronic circuit; and effect closing of the second MEMS switch that resides in the electronic circuit by applying the actuation signal to the second MEMS switch and subsequently applying a hold signal to the second MEMS switch to maintain the second MEMS switch in a closed position, wherein the actuation signal used to close the second MEMS switch is repeatedly updated based on operation of the first MEMS switch.

29. A system comprising:

a first encapsulating structure; and a second encapsulating structure attached and substantially sealed to the first encapsulating structure to form a plurality of cavities between the first encapsulating structure and the second encapsulating structure to provide a common environment to a plurality of micro-electro-mechanical system (MEMS) switches;

the plurality of devices; and comprising switch control circuitry wherein:

the system is adapted to control movement of a MEMS switch from a closed position to reduce ringing;

the plurality of MEMS switches comprises a first MEMS switch; and the switch control circuitry is associated with the first MEMS switch and adapted to:

apply a hold signal to the first MEMS switch to maintain a movable portion of the first MEMS switch in the closed position, wherein when no signal is applied to the first MEMS switch, the movable portion of the first MEMS switch is normally in a resting position;

remove the hold signal from the first MEMS switch to initiate returning of the first MEMS switch to the resting position; and after removing the hold signal, apply to the first MEMS switch a release signal configured to retard a rate at which the movable portion of the first MEMS switch approaches the resting position sufficiently to avoid significant mechanical oscillations of the movable portion of the first MEMS switch after removal of the hold signal.

* * * * *